United States Patent [19]

Nielsen

[11] Patent Number: 4,463,682

[45] Date of Patent: Aug. 7, 1984

[54] RAILWAY TRACK TAMPING MACHINE

[75] Inventor: Arne Nielsen, La Conversion, Switzerland

[73] Assignee: Sig Societe Industrielle Suisse, Neuhausen Chutes du Rhin, Switzerland

[21] Appl. No.: 348,972

[22] Filed: Feb. 16, 1982

[30] Foreign Application Priority Data

Feb. 24, 1981 [CH] Switzerland ..... 1199/81

[51] Int. Cl.[3] ..... E01B 27/16

[52] U.S. Cl. ..... 104/12

[58] Field of Search ..... 104/7 R, 7 B, 10, 12; 29/33 J

[56] References Cited

U.S. PATENT DOCUMENTS 500,954 7/1893 Rundquist ..... 29/33 J X 2,051,720 8/1936 Kingsbury ..... 29/33 J X

FOREIGN PATENT DOCUMENTS 256588 1/1964 Australia ..... 104/12

2737778 6/1978 Fed. Rep. of Germany ..... 104/12

*Primary Examiner*—Randolph Reese

*Attorney, Agent, or Firm*—Anthony J. Casella; Gerald E. Hespos

[57] ABSTRACT

A tamping machine is provided with tamping tools for tamping open track and track adjacent switch gear. Each tool is mounted on an oscillating and pivoting lever which is articulated to a frame mounted for vertical movement in a gantry suspended from the chassis of the tamping machine and movable in both transverse and longitudinal directions with respect to the track. Each tool has two picks with blades of unequal length radially separated from each other and rotationally mounted on the lever in a plane transverse to the track. The two picks on each tool are interchangeable and can be locked into working position.

1 Claim, 3 Drawing Figures

20
22
21
18
34
35
31
4
23
2
3
F 1
14
13
10
12
35
4
22
9
36
15
16
19
7
18
21
23
31
34
8
9
11
20
2
3

1
14
13
10
12
19
7
18
21
23
33
32
35
31
4
22
2
16
15
17
34
8
9
11
20
3

RAILWAY TRACK TAMPING MACHINE

The object of the present invention is a railway track tamping machine of the type adapted to tamp switch gear as well as the open track.

Tamping machines are already known in which the chassis is equipped for this purpose with a plurality of tamping units movable in the transverse direction of the track in order to tamp the track on both sides of the two lines of rail as well as around the switches, and on which each of these units has at least two tamping tools which are mounted in opposition on a vertically movable carrying frame and each of which is supported by a lever which oscillates and pivots in a plane parallel to the track, on which tamping units the said tools are formed of picks provided with end blades of a length determined to compact the ballast below the ties and along a limited portion of the ties.

Of these known tamping machines, the length of the blades of the picks of the tamping tools is necessarily limited to a reasonable minimum which will permit their insertion between each of the two rails of the track moved over by the tamping machine and the lateral obstacles encountered in the switches and their immediate environment, such as, for instance, those formed of the two lines of rail of the competitive track in a simple switch. The distance available for this insertion decreases, as a matter of fact, as the rails of the competitive track approach the rails of the track moved along by the tamping machine and the length of the blades in question determines the limit as from which the insertion is no longer possible, i.e., therefore, the limit as from which the compacting of the ballast can no longer be effected under the ties between these competitive rails. It would therefore be advantageous to reduce this limit by reducing the length of the blades of the picks to the minimum useful to assure compacting under the maximum number of ties between the said rails.

On the other hand, on the open track, this limitation has no longer any reason for existence in view of the absence of obstacles on either side of the two rows of rails.

As tamping machines of the aforementioned type are intended for tamping both on the open track and around switch gear, the selection of the length of the blades of the picks of their tamping tools is thus necessarily dictated by a compromise between the two criteria of efficiency and quality - a sufficiently extensive compacting of the ballast upon each plunging movement of the tools below the ties in order to assure them a good seat and as complete a compacting of the ballast as possible under the maximum number of ties bearing the track gear.

This compromise necessarily leads to a length of the pick blades which is both too short for the open track and too long for the switches to assure each tamping tool optimal operating characteristics in these two uses.

The object of this invention is to overcome this drawback in a simple, reliable manner.

For this purpose, the tamping machine of the invention is characterized by the fact that each tamping tool is composed of two picks which are mounted for rotation in a plane transverse to the track on the oscillating, pivoting lever bearing the said tool, by the fact that the length of the blade of one of these two picks corresponds to the desired extent of compacting for the tamping of the track switches, by the fact that the length of the blade of the other pick corresponds to the desired extent of compacting for the tamping of the open track, and by the fact that these two picks are interchangeable and can be locked in working position and in non-working position respectively by rotation and angular immobilization in said positions by means of at least one blocking member.

In this way, by simple interchange of the two picks of each tamping tool it is possible to adjust the extent of the compacting which can be effected upon each plunge of these tools into the ballast to that desired in the open track and in the switches.

The accompanying drawing shows, by way of example, one embodiment of the tamping unit which characterizes the object of the present invention.

Figure 3:
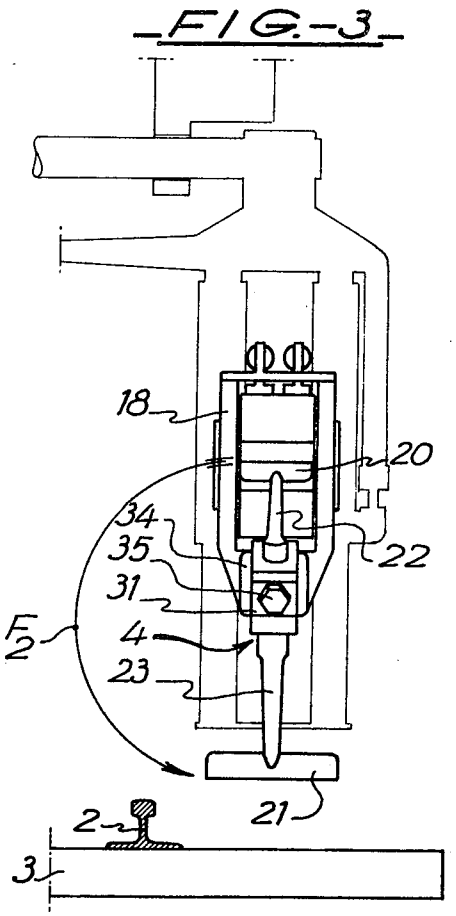
FIGS. 2 and 3 are two profile views illustrating the two positions of their tools.

The tamping unit shown is of the type adapted to tamp one side of a line of rails and the tamping machine (of which only a part of the chassis 1 is shown) has four tamping units arranged in pairs above the two lines of rails, only one of which, marked 2, is shown in the drawing, in order to assure the compacting of the ballast beneath the ties 3 of the track.

This tamping unit has two tamping tools 4 mounted in opposition on a carrying frame 7 which in its turn is mounted for vertical movement in a gantry 8. This gantry is formed of two parallel columns 9 connected at their ends by an upper cross member 10 and a lower cross member 11. The carrying frame 7 slides along two columns 9 and its movements are controlled by a hydraulic piston-cylinder unit 12 resting against the upper cross member 10. The gantry 8 is connected to the chassis of the tamping machine by a suspension system comprising a double articulation 13–14 imparting to it pendulum mobility both in a plane transverse to the track and in a plane parallel to it, and a shaft 15 which slides in the transverse direction of the track and is supported by two bearing brackets fastened to the chassis 1, only one of which (16) is visible in these figures, the said shaft 15 supporting the double articulation 13–14. This system of suspending the tamping unit is intended to permit transverse and longitudinal evasion of the obstacles created by the switch gear and has driving piston-cylinder units connected to the chassis 1, only one of which, the unit 17, is shown in order not to needlessly clutter the drawing.

Each of the tools 4 of this embodiment of the tamping unit is borne by a lever 18 which oscillates and is pivoted in a plane parallel to the track and is articulated to the carrying frame 7; the latter is in this case in the form of a housing containing the mechanism for the oscillating of the said tools. The pivoting of the two levers 18 articulated on the carrying frame 8 which is intended to assure the closing of the two tamping tools around each tie 3 of the track is controlled by two hydraulic piston-cylinder units 19 which rest against the said carrying frame between the two columns 9 of the gantry 8.

Each of the tamping tools 4 consists of two picks 22 and 23 mounted for rotation in a plane transverse to the track on the lever 18 via a rotary turret 31 on which these two tools are fixed radially in two different angular positions which in this case are 180° apart.

Figure 2:
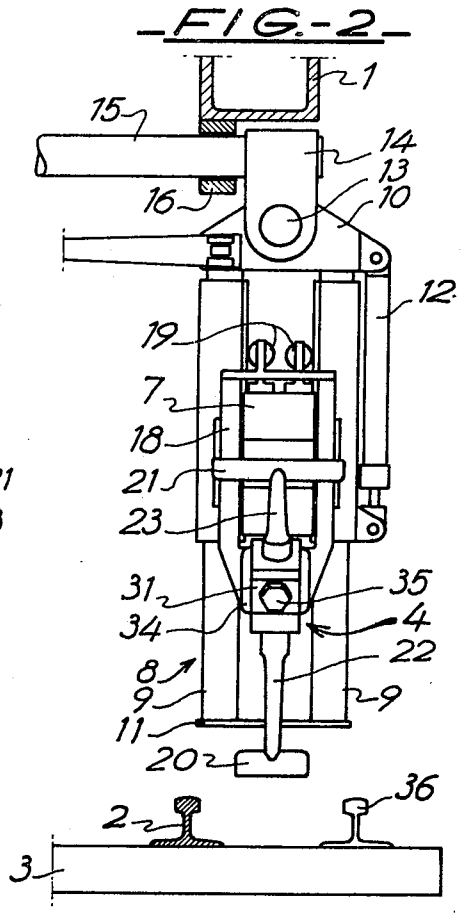
Figure 1:
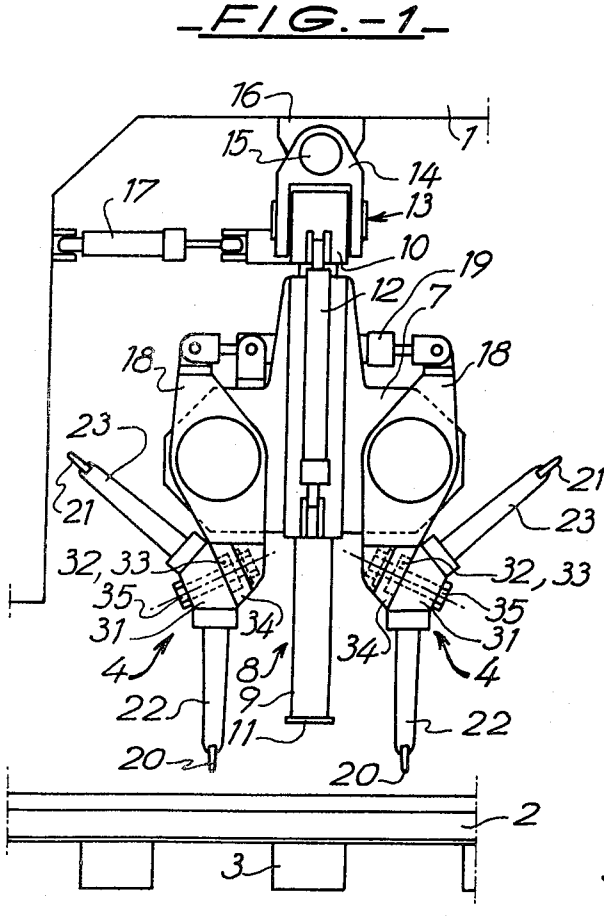
FIG. 1 is a face view thereof.

One of these two picks, the pick 22, has a blade 20 whose length, considered in the direction of the ties 3 of the track, corresponds to the desired extent of the compacting in the switches and is selected in accordance with the quality criteria defined previously for its insertion between the rails 2 of the track and the obstacles, such as the competitive rail 36 of a switch shown in FIG. 2.

The other pick, the pick 23, has a blade 21 whose length corresponds to the desired extent of compacting in the open track upon each plunge of the tools into the ballast. As a result, the blade 21 is necessarily longer than the blade 20 of the pick 22.

The rotary turret 31 has a trunnion 32 in the shape of a projection engaged in a counter-bore 33 in a base 34 rigidly fastened to the lever 18, and this turret is maintained against this base by an axial clamping bolt 35.

By the blocking effected by this bolt 35, the turret 31 is locked against the base 34 either in the operating position of the pick 22, in which case the pick 23 is naturally in non-operating position, as shown in FIG. 2, or in the operating position of the said pick 23, in which case the pick 22 is naturally in non-operating position, as shown in FIG. 3. The passage from one position to the other is effected here manually by swinging the turret-blade assembly 180° in the direction indicated by the arrow $F_2$.

The angular distance between the pick 22 and the pick 23 may be less than 180° to the extent that the pick which is not in operation is located above the level of the running surface of the rails during the tamping and does not interfere with the adjacent tamping unit as a result of its size.

The rotary mounting of the two picks 22 and 23 on the lever 18 of each tamping tool may be effected in other manners.

Thus, for instance, it is conceivable to articulate each of them independently of the other on the said lever, either on the same shaft or on two shafts spaced apart in the direction transverse to the track. In this latter case, the two picks will be bent in their plane of rotation in order to present themselves in working position in the same relative position with respect to the carrying frame 7.

However, the embodiment which has been described above by way of example has the advantage of simplicity over this variant.

Finally, the rotation of the picks which is necessary for their interchange as well as their blocking in working and non-working positions may be mechanized without going beyond the scope of the invention, but such mechanization is not indispensable for the purpose in view.

I claim:

1. A railway track tamping machine for tamping switches as well as open track, comprising in combination:

(a) a rolling chassis;

(b) a plurality of tamping units mounted on said rolling chassis, said stamping units being displaceable in the transverse direction of the track to tamp the track on either side of each line of rails as well as to avoid lateral obstacles upon tamping of track switches;

(c) a tool carrying frame mounted for vertical movement in each of said tamping units;

(d) two levers mounted in opposition on said tool carrying frame, said levers being articulated on the tool carrying frame for oscillating and pivotal movement in a plane parallel to the longitudinal direction of the track;

(e) a first tamping pick and a second tamping pick mounted on each of said two levers, said first and second tamping picks forming with their respective lever one tamping tool located on one side of a line of rails;

(f) a first end blade mounted respectively on each said first tamping pick and a second end blade mounted respectively on each said second tamping pick, said second end blades being longer than said first end blades;

(g) means for pivoting each said first tamping pick on its respective lever in a plane transverse to the track between a first position in which said first tamping pick is raised in non-working condition and a second position in which said first tamping pick is lowered in working condition;

(h) means for pivoting each said second tamping pick on its respective lever in a plane transverse to the track between a first position in which said second tamping pick is lowered in working condition and a second position in which said second tamping pick is raised in non-working condition, (i) means for simultaneously immobilizing on the lever said first and second tamping picks in said first positions or in said second positions; and, (j) means for positioning said first or second end blades of each said tamping tool that are in their respective working positions at the same relative disposition with respect to said tool carrying frame when said first tamping pick is in said second position or when said second tamping pick is in said first position.

* * * * *